US009517909B2

(12) United States Patent
Bauer et al.

(10) Patent No.: US 9,517,909 B2
(45) Date of Patent: Dec. 13, 2016

(54) DEVICE FOR WINDING RIBBON-LIKE MATERIAL ONTO SPOOLS

(71) Applicant: Schroeder + Bauer GmbH & Co. KG, Neulingen-Bauschlott (DE)

(72) Inventors: Frank Bauer, Pforzheim (DE); Thomas Standke, Pforzheim (DE); Mirko Lindenmann, Neulingen Pforzheim (DE)

(73) Assignee: SUBA HOLDING GMBH + CO. KG, Neulingen-Bauschlott (DE)

( * ) Notice: Subject to any disclaimer, the term of this patent is extended or adjusted under 35 U.S.C. 154(b) by 413 days.

(21) Appl. No.: 13/966,810

(22) Filed: Aug. 14, 2013

(65) Prior Publication Data

US 2014/0048642 A1 Feb. 20, 2014

(30) Foreign Application Priority Data

Aug. 17, 2012 (DE) ..... 10 2012 016 479

(51) Int. Cl.
*B65H 18/08* (2006.01)
*B65H 19/22* (2006.01)

(52) U.S. Cl.
CPC ..... *B65H 18/08* (2013.01); *B65H 19/223* (2013.01); *B65H 19/2207* (2013.01); *B65H 19/2215* (2013.01); *B65H 2701/1942* (2013.01)

(58) Field of Classification Search
CPC ..... B65H 19/2207; B65H 19/30; B65H 19/12; B65H 19/123; B65H 19/126; B65H 19/223; B65H 19/22; B65H 19/2215; B65H 19/2223; B65H 18/08; B65H 19/10; B65H 2701/1942; B65H 19/00

(Continued)

(56) References Cited

U.S. PATENT DOCUMENTS 2,327,906 A * 8/1943 Kiefer ..... B21C 47/24 100/1
2,332,576 A * 10/1943 Iversen ..... B21C 47/26 242/571.3

(Continued)

FOREIGN PATENT DOCUMENTS

DE 1 933 926 1/1971

*Primary Examiner* — Sang Kim
*Assistant Examiner* — Nathaniel Adams
(74) *Attorney, Agent, or Firm* — Rabin & Berdo, P.C.

(57) ABSTRACT

Described is a device for winding ribbon-like material onto spools. Said device comprises at least a first rotating body (10*a*, 10*b*) that can rotate around a spool axis (S) and at least a second rotating body (20) that can rotate around the spool axis (S) and can furthermore be moved relative to the spool axis (S) in axial direction from a first end position to a second end position. Thus, the second rotating body (20) when it is in the first end position is located closer to the first rotating body (10*a*, 10*b*) than when it is in the second end position. The two rotating bodies (10*a*, 10*b*; 20) can rotate jointly around the spool axis, at least when the second rotating body (20) is located in its first end position. To ensure an uninterrupted operation even if the spools used are made of cardboard and have side walls that are not completely planar or flat, at least one of the rotating bodies (10*a*, 10*b*; 20) is provided with a holding element, in particular in the form of a pneumatic suction element (32), for pulling a side wall (54) of a spool (50, 50'). For this, the holding element has a holding side whose position relative to the rotating body (10*a*, 10*b*; 20) can be changed.

11 Claims, 12 Drawing Sheets

(58) Field of Classification Search
USPC ..... 242/533, 533.1, 533.2, 533.7
See application file for complete search history.

(56) References Cited

U.S. PATENT DOCUMENTS

| | | | | |
|---|---|---|---|---|
| 2,567,670 | A * | 9/1951 | Iversen | B21C 47/28 242/592 |
| RE23,450 | E * | 1/1952 | McVicker | F16N 7/12 19/149 |
| 3,478,974 | A * | 11/1969 | Nelson | B65H 19/10 242/560 |
| 4,681,505 | A * | 7/1987 | Kobayashi | B65H 19/123 414/744.6 |
| 5,289,985 | A * | 3/1994 | Cocchi | B65H 19/123 242/559 |
| 6,015,114 | A | 1/2000 | Randazzo et al. | |
| 6,604,704 | B2 * | 8/2003 | Kiprowski | B65H 19/123 242/559 |
| 2006/0151659 | A1 | 7/2006 | Anderson | |

* cited by examiner

DEVICE FOR WINDING RIBBON-LIKE MATERIAL ONTO SPOOLS

BACKGROUND OF THE INVENTION

1. Field of the Invention

The invention relates to a device for the winding of a ribbon-like material as disclosed in claim 1.

2. Description of the Related Art

Nowadays, contact elements used in particular in the field of electrical engineering are produced in large piece numbers with the aid of the stamping technique. In the process, the contact elements leave the stamping machine while being attached to at least one support strip, so that a ribbon-like material is obtained which consists of the aforementioned at least one support strip and the stamped out contact elements. In order to transport this ribbon-like material to a further processing step, for example for the galvanizing, the ribbon-like material is wound onto spools, wherein cardboard spools are frequently used for this.

These cardboard spools have the advantage of low cost and low weight which also keeps the transport costs low, wherein it is a further advantage that they can be recycled immediately after use. A cardboard spool of this type comprises a spool core and two circular side walls which are held in place by the spool core and—in the ideal case—extend parallel to each other.

In the simplest case, a device for winding the ribbon-like material onto such a spool comprises a drive motor which can put a rotating body into rotation. Extending outward from this rotating body is a shaft onto which the spool is fitted. Furthermore extending outward from this rotating body are mandrels, for example, which burrow into a side wall of such a cardboard spool, thus forming a temporary, rotationally fixed connection between the rotating body and the cardboard spool. In the simplest case, the spools, once they are full, are replaced manually by a person. However, more involved arrangements of this type are also known in the technical field, in which the spool replacement takes place automatically or semi-automatically.

One problem that frequently occurs when using the aforementioned cardboard spools is that the parallel orientation of the side walls cannot be perfectly maintained, meaning the side walls are slightly wavy, in particular along the edge region. In the worst case, the ribbon-like material to be wound onto the spool can thus be caught on one side wall of the cardboard spool, thereby resulting in damage to the produced components (in most cases these are contacts) or in a machine stop because the winding operation must be interrupted.

Starting therefrom, it is the object of the present invention to provide a device for the winding of ribbon-like material which functions without problem even if the cardboard spool used has side walls with uneven sections.

SUMMARY OF THE INVENTION

This object is solved with a device having the features as disclosed in claim 1.

The device according to the invention comprises at least a first rotating body which can rotate around a spool axis, as well as a second rotating body that can rotate around the spool axis. A shaft preferably extends outward from one of these two rotating bodies. The second rotating body can be moved in axial direction from a first end position to a second end position, relative to the spool axis, wherein the second rotating body when occupying the first end position is closer to the first rotating body than when occupying its second end position. At least one rotational drive is provided for putting the two rotating bodies into rotation, such that they rotate jointly around the spool axis, at least when the second rotating body is in its second end position. In a winding position, the two rotating bodies can thus rotate next to each other and jointly around the spool axis, wherein the shaft is coaxial to the spool axis. In this state of the device, a spool and in particular a cardboard spool is positioned between the two rotating bodies and is held in place, when the device is operated. At least one of the two rotating bodies—preferably both—is provided with holding elements for pulling at least one side wall of a spool. For this, the holding elements respectively comprise a holding side that can be moved relative to the rotating body.

With the aid of the holding elements, preferably embodied as pneumatic suction elements, at least one side wall of a spool and preferably both side walls are pulled from the outside to a defined position. This position can either be a position where the side walls are completely parallel to each other or also a position where the spacing between the two side walls increases in a defined manner from the inside toward the outside which can additionally facilitate the intake of the ribbon-like material. This defined influencing of the configuration of the side walls for the spools is preferably achieved fully automatically.

Since the improvement of the device as disclosed for the invention prevents a catching of the ribbon-like material during the intake onto the spool, this operation in particular does not require the monitoring by operating personnel. The option is thus provided for operating the device fully automatically and at high speed. According to one preferred embodiment, the device is provided with two first rotating bodies which can change position, for example with the aid of a rotating or pivoting movement.

As mentioned before, the holding elements are advantageously embodied as pneumatic suction elements, wherein it is furthermore preferable if the suction elements are embodied such that when they are not subjected to a negative or vacuum pressure, they have a longer length than when they are subjected to a negative pressure. Pneumatic suction elements of this type are known from the prior art and can be purchased commercially.

BRIEF DESCRIPTION OF THE DRAWINGS

Additional preferred embodiments and advantages follow from the dependent claims and the exemplary embodiments explained in further detail with reference to the Figures, showing in:

DETAILED DESCRIPTION OF THE INVENTION

Figure 1:
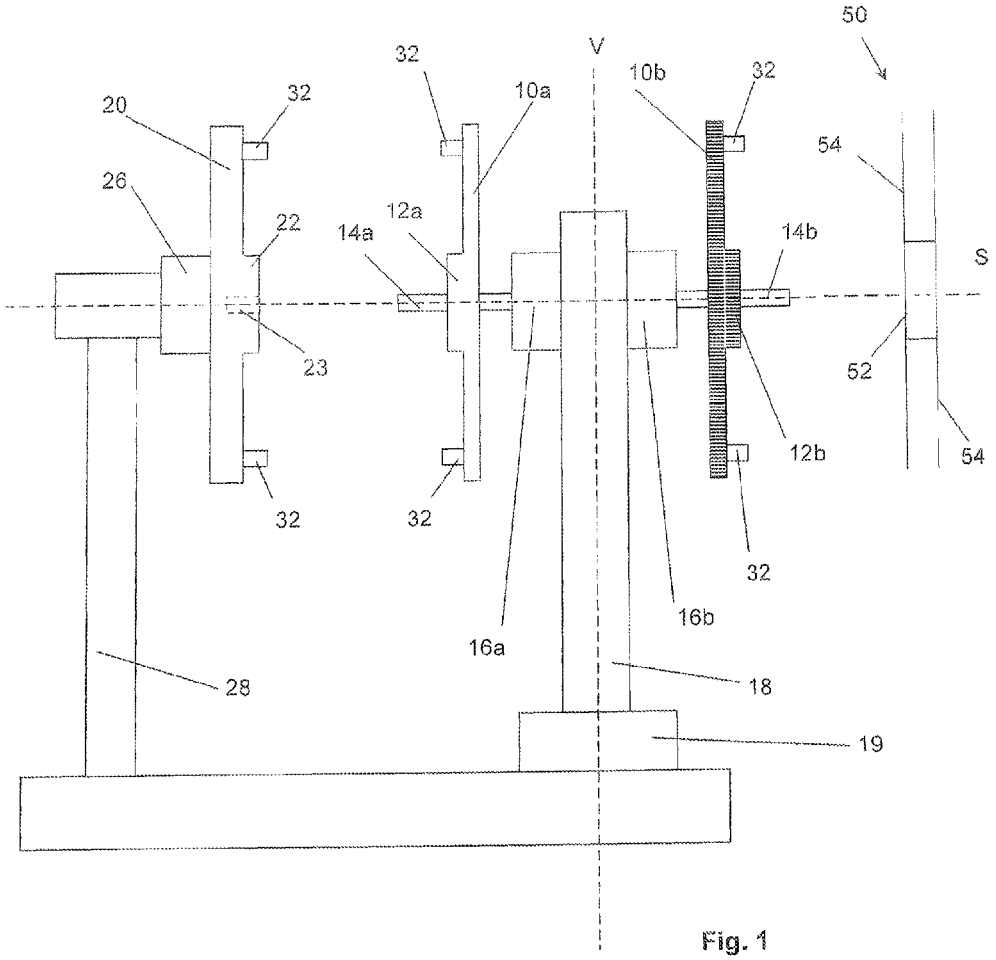
FIG. 1 a simplified, diagrammatic view from the side of a first exemplary embodiment of the invention, as well as a cardboard spool.

The essential components and the mode of operation of the invention are described with the aid of a first exemplary embodiment shown schematically in FIGS. 1 to 11, wherein reference is initially made to FIG. 1:

The device comprises a vertically extending arm 18 which can be pivoted around the vertical axis V. A drive in the form of a motor 19 is provided for this pivoting movement. The vertical arm 18 supports two first rotating bodies 10*a*, 10*b* which are configured identically. However, the first rotating body given the reference 10*b* in FIG. 1 is shown on the right side with hatching, so that a distinction can be made between the two first rotating bodies 10*a*, 10*b* in the following description of the mode of operation of the device. The two first rotating bodies 10*a*, 10*b* are respectively connected with the vertical arm 18 in a rotating manner, wherein separate drive motors 16*a*, 16*b* are used for this in the exemplary embodiment. As can be seen later on, however, other types of embodiments are conceivable in which the two rotating bodies 10*a*, 10*b* are respectively connected only with a bearing to the vertical arm 18, meaning they are not driven directly. A separate shaft 14*a*, 14*b* extends outward from the center of each of the two first rotating bodies 10*a*, 10*b*, wherein these shafts 14*a*, 14*b* are aligned with each other and extend coaxial to a spool axis S when in the operating position, as shown in FIG. 1. For the exemplary embodiment shown, the hub or center regions 12*a*, 12*b* of the first rotating bodies 10*a*, 10*b* are somewhat thicker than the edge regions of the first rotating bodies 10*a*, 10*b*.

The first rotating bodies 10*a*, 10*b* are respectively provided with several pneumatic suction elements 32 near the edge which function as holding elements, where the preferred design of these pneumatic suction elements 32 will be discussed in more detail later on in connection with FIGS. 17 and 18. These pneumatic suction elements 32 extend in a longitudinal direction parallel to the shafts 14*a*, 14*b*.

The device furthermore comprises a movable arm 28 which is provided with a second rotating body 20 which can rotate around the spool axis S and can be actuated to rotate in the respective rotational direction with the aid of a drive motor 26. In the same way as the two first rotating bodies 10*a*, 10*b*, this second rotating body has a thickened hub area 22 and is provided with pneumatic suction elements 32 as holding elements. Each rotating body is provided with four to eight such pneumatic suction elements 32, preferably distributed symmetrically, wherein only two of these suction elements are shown in FIG. 1.

In contrast to the two first rotating bodies 10*a*, 10*b*, the second rotating body 20 is not provided with a shaft, but with a recess 23 that extends coaxial to the spool axis. The movable arm 28 (and thus also the second rotating body 20) can be moved parallel to the spool axis S from a first end position to a second end position, wherein FIG. 1 shows the second end position in which the rotating body 20 is at a maximum distance to the first rotating bodies. The drive mechanism for the movable arm 28 is not shown in FIG. 1. Finally, a spool 50 is also shown schematically in FIG. 1. This spool includes a spool core 52, and two circular side walls 54 which are held at the spool core 52. As previously mentioned, the spool 50 material is cardboard.

Figure 17:
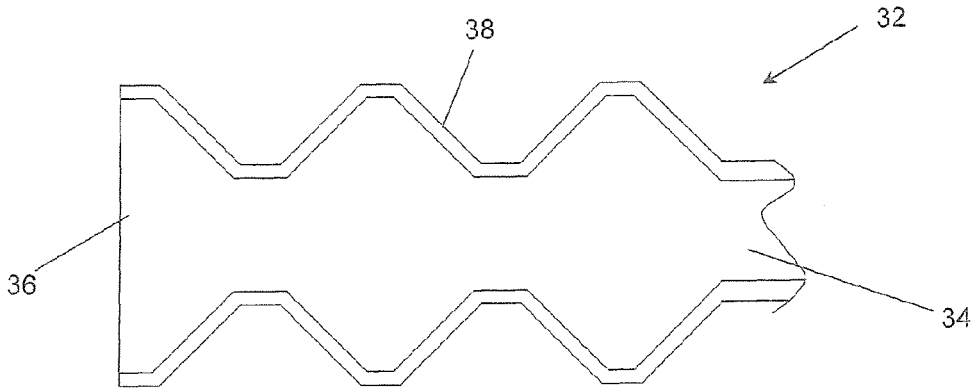
FIG. 17 a cross-sectional view of a pneumatic suction element in a first operating position.
Figure 18:
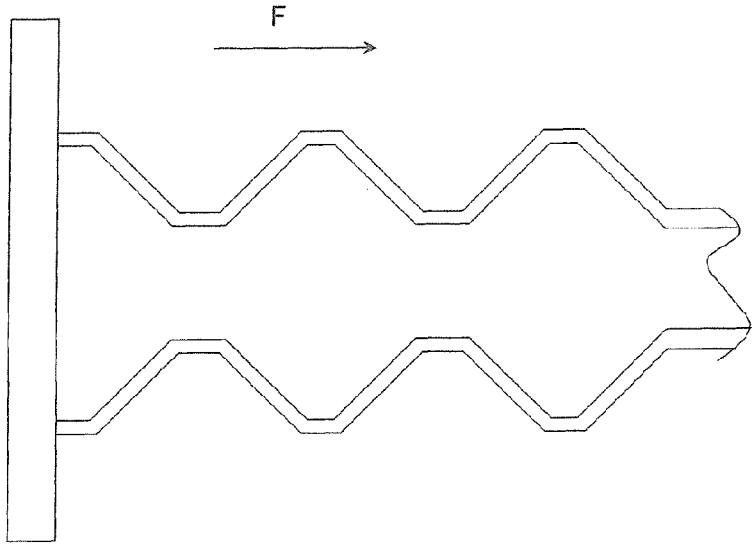
FIG. 18 the pneumatic suction element shown in FIG. 17, wherein its suction side fits against a substantially flat object.
Figure 19:
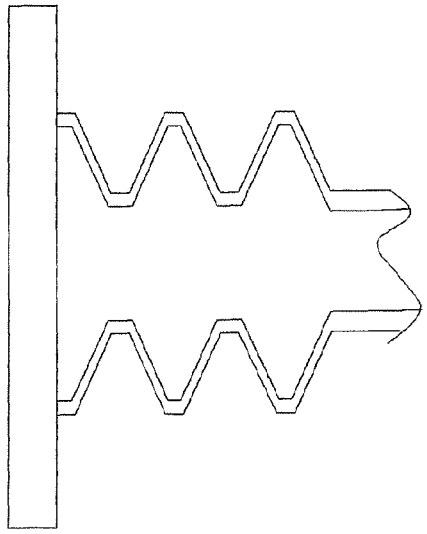
FIG. 19 the pneumatic suction element from FIG. 18, shown in a second operating position.

FIGS. 17 to 19 contain diagrammatic sectional views of a pneumatic suction element 32, such as the one preferably used for the present invention. The pneumatic suction element 32 is composed of an elastic material such as rubber or silicon. The pneumatic suction element 32 extends in an axial direction (during the winding operation this is parallel to the spool axis; the pneumatic suction elements of the second rotating body always extend parallel to the spool axis) from a connection side 34 to a suction side 36. The center section 38 that extends in-between is embodied as a bellows. The suction side 36 is completely open or at least is provided with a hole. The connection side 34 is connected fixedly to the respective rotating body.

If the suction side 36 makes contact with an essentially flat object (for the device according to the invention the outside surface of a side wall 54 of a spool 50) and if the connection side 34 is connected to a suction pump, a negative pressure is generated within the pneumatic suction element 32 because of the fact that the hole on the suction side 36 is closed off by the object, thus causing the suction element to exert a force in the direction F onto the essentially flat object. Insofar as the respective object can move in that direction, the center section 38 contracts and pulls the object in the direction F. The suction side 36 thus forms the holding side of the pneumatic suction element.

In FIG. 1, the pneumatic suction elements 32 are shown in a state where they have a maximum length, meaning in axial direction they extend somewhat over the thickened hub regions 12*a*, 12*b*, 22.

Figure 2:
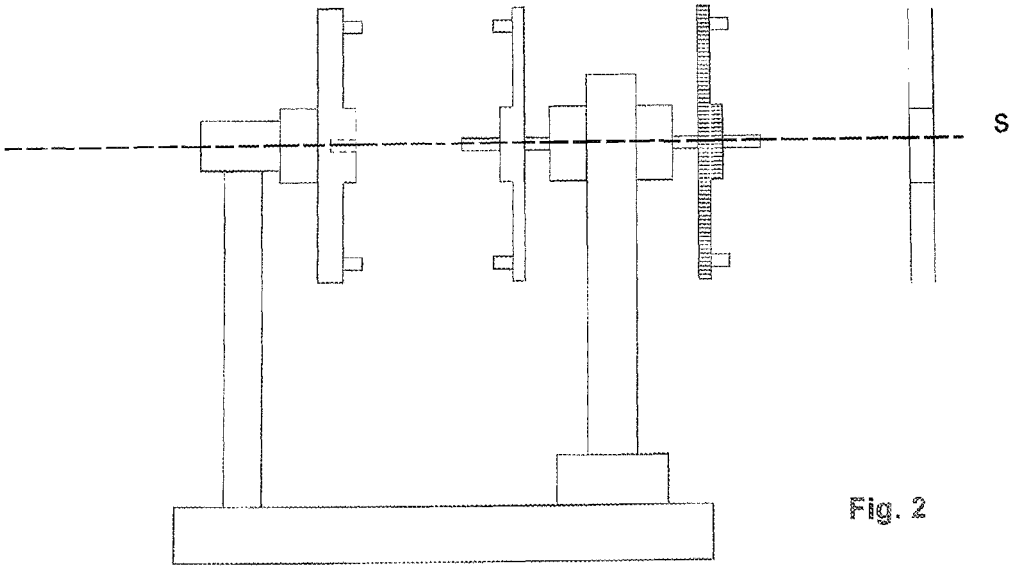
FIG. 2 the same embodiment as in FIG. 1, shown in a first operating position.
Figure 3:
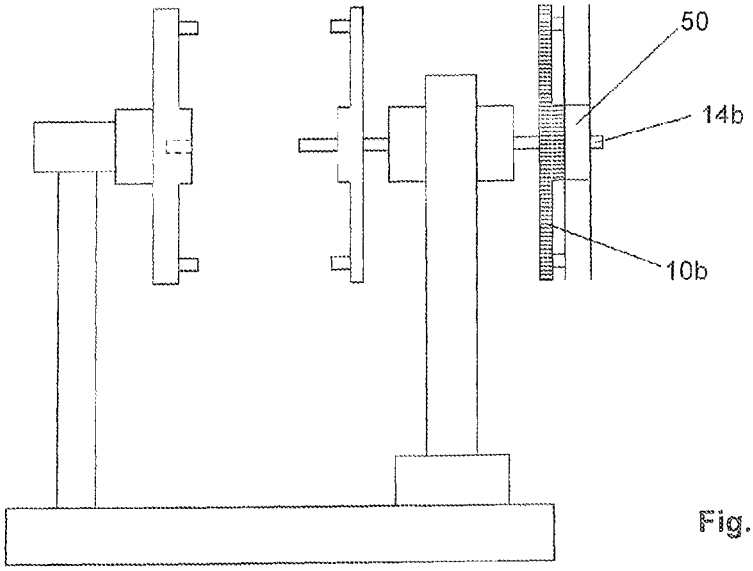
FIGS. 3-11 a complete cycle for the representations corresponding to FIG. 2.

The operational mode of the device is now explained with reference to FIGS. 2 to 11. FIG. 2 shows the same state as shown in FIG. 1, a state in which a spool has not yet been arranged on a rotating body. This state can occur, for example, when the stamping machine which supplies the ribbon-like material to be wound onto the spool 50 is restarted following an interruption in the production. During the uninterrupted operation, a spool is always arranged on a first rotating body, as shown later on. The spool 50 is fitted during an operational step onto the shaft 14*b* of the first rotating body 10*b* which points away from the second rotating body 20, wherein this is shown in FIG. 3.

Figure 4:
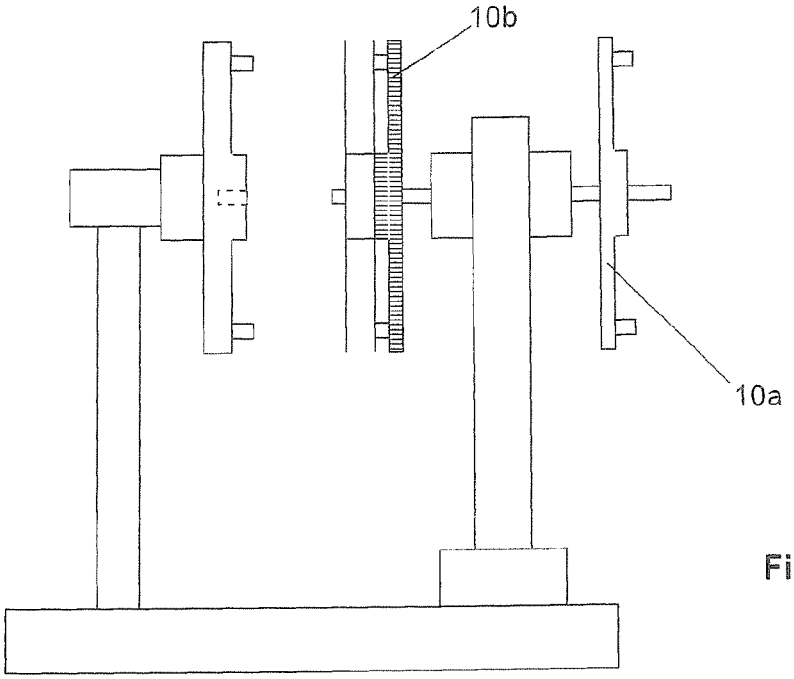
Figure 5:
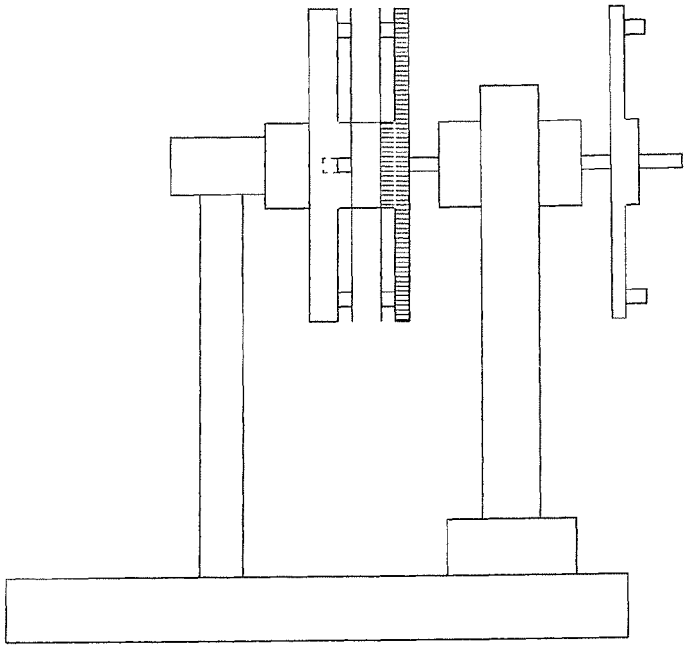
Figure 6:
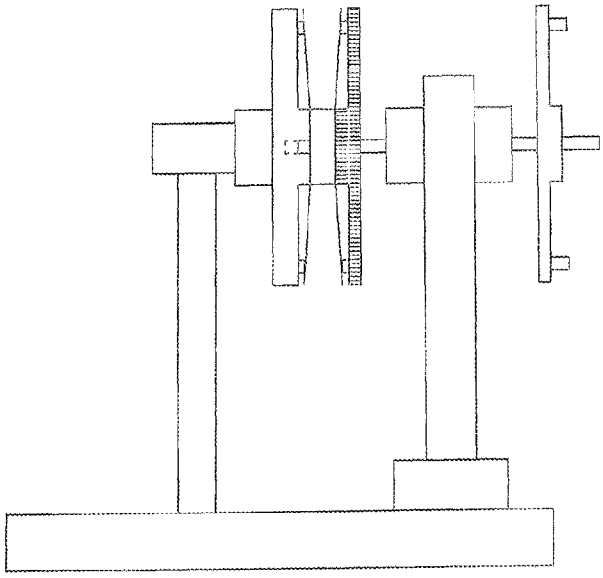
Figure 7:
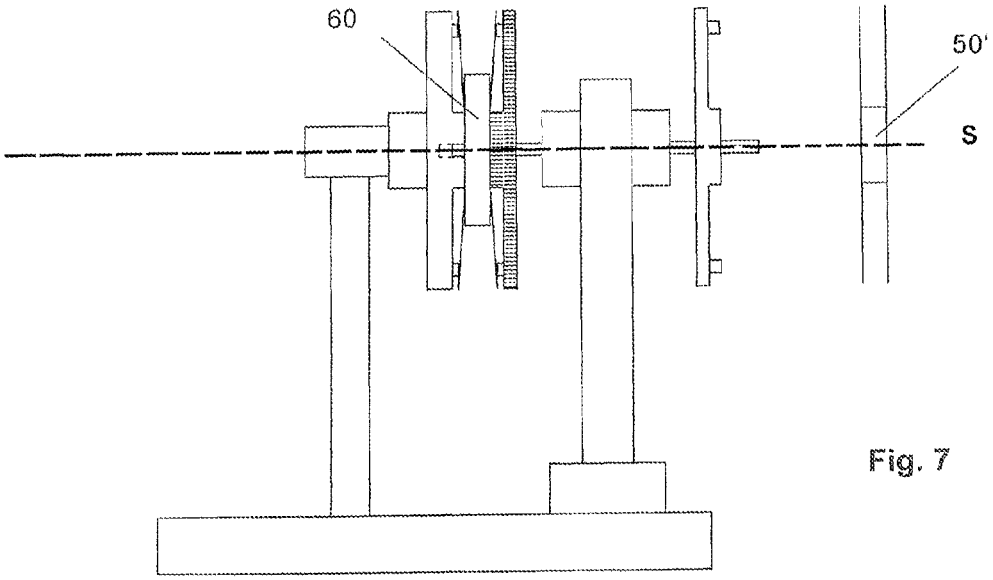
Figure 8:
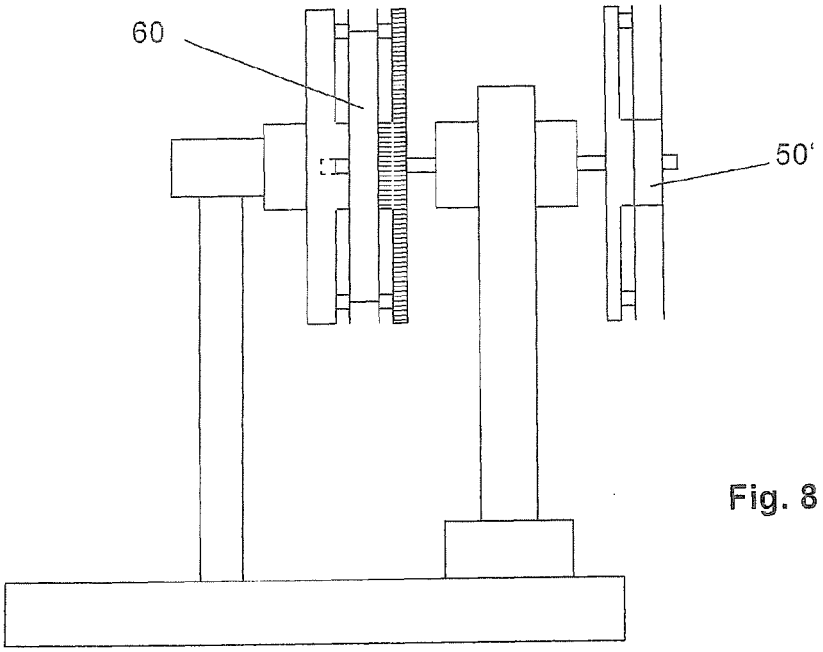

The vertical arm subsequently rotates by 180° and moves the first rotating body 10*b* to the position shown in FIG. 4 in which it is arranged opposite the second rotating body 20. During the rotation of the vertical arm 18, the two shafts 14*a*, 14*b* are of course not coaxial to the spool axis. However, once they reach the state shown in FIG. 4, this condition is met once more. The second rotating body 20 is then moved with the aid of its movable arm 28 to its first end position, as shown in FIG. 5, in which the spool core 52 is clamped in between the hub regions 12*b* and 22 and all pneumatic suction elements 32 are pressed lightly against the side walls 54 of the spool 50 that is held between the rotating bodies 10*b* and 20. In this first end position, the shaft 14*b* extends into the recess 23. As a result, it is possible to use spools of differing thickness. The pneumatic suction elements are then activated (meaning supplied with negative pressure), so that they can adhere with suction to the outside of the side walls 54 and pull these toward the outside to achieve the state shown in FIG. 6. The bulging of the side walls 54 toward the outside is shown strongly exaggerated herein.

In this operating state, the first rotating body 10*b* and the second rotating body 20 are put into rotation around the spool axis, wherein the two drive motors 16*b* and 26 which are used for the embodiment shown herein are synchronized. As already indicated briefly, however, it would also be possible to omit the drive motors 16*a*, 16*b* and to use only the second drive motor 26 to jointly put into motion the second rotating body 20 and the respective first rotating body. An rotationally fixed connection between the shaft 14*a*, 14*b* and the recess 23 could be used in that case.

Figure 9:
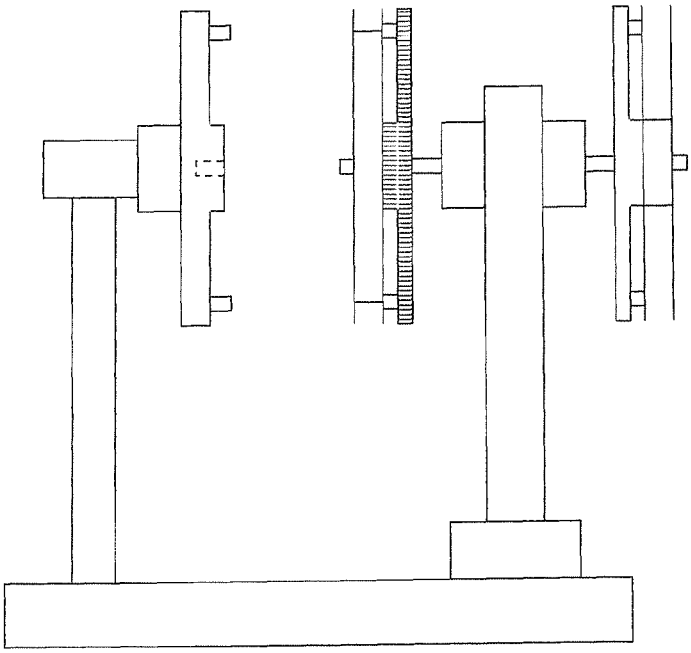
Figure 10:
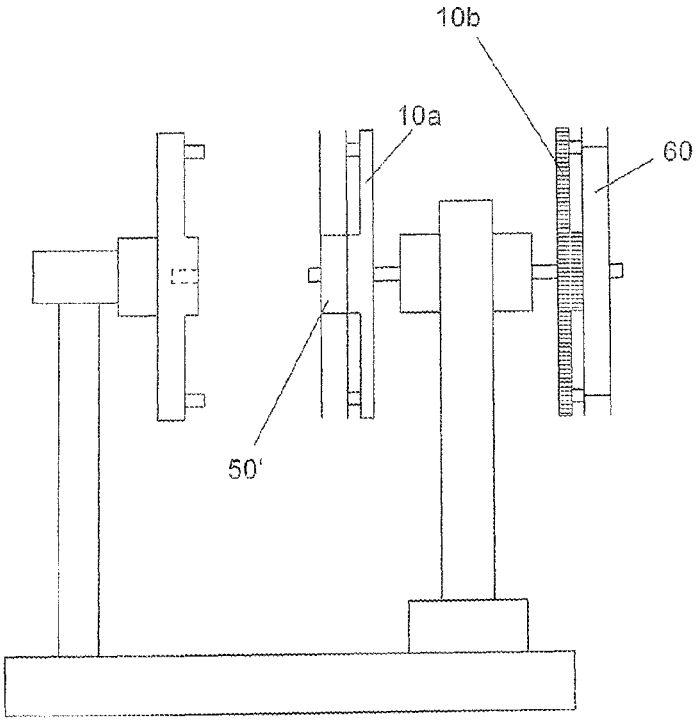
Figure 11:
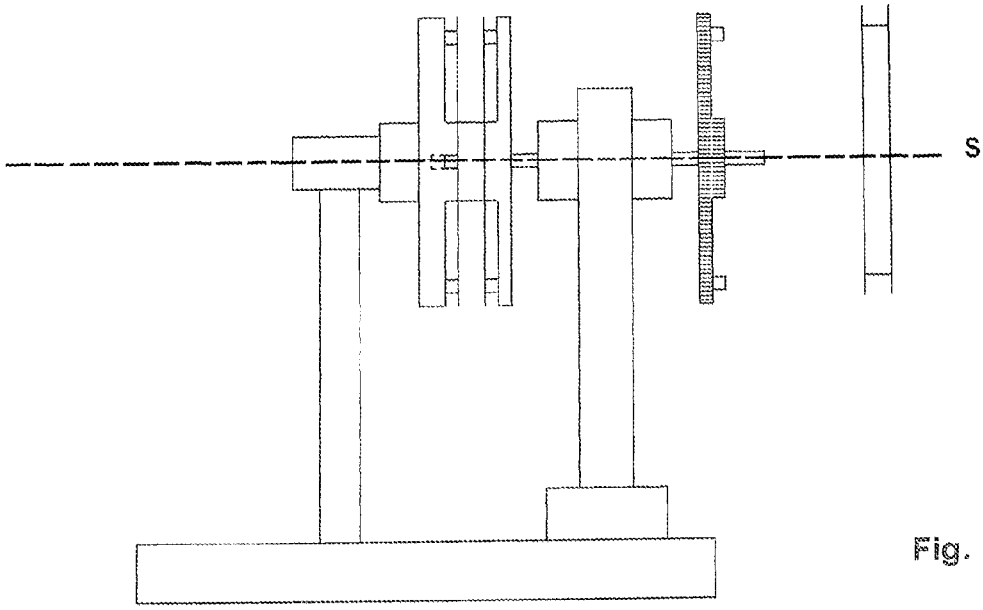
Figure 12:
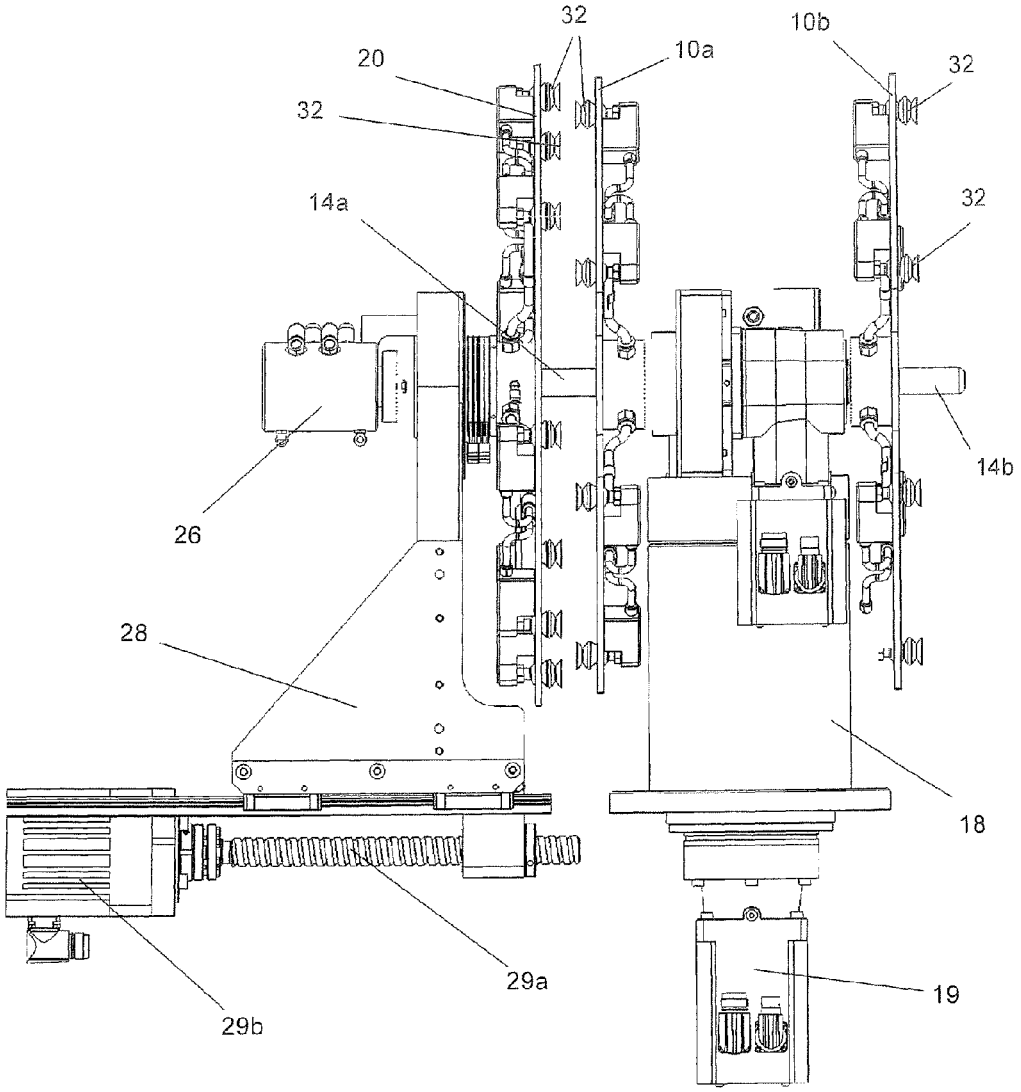
FIG. 12 a second exemplary embodiment of the invention in a view from the side, corresponding essentially to FIG. 5, but with more detail and without the spool.
Figure 13:
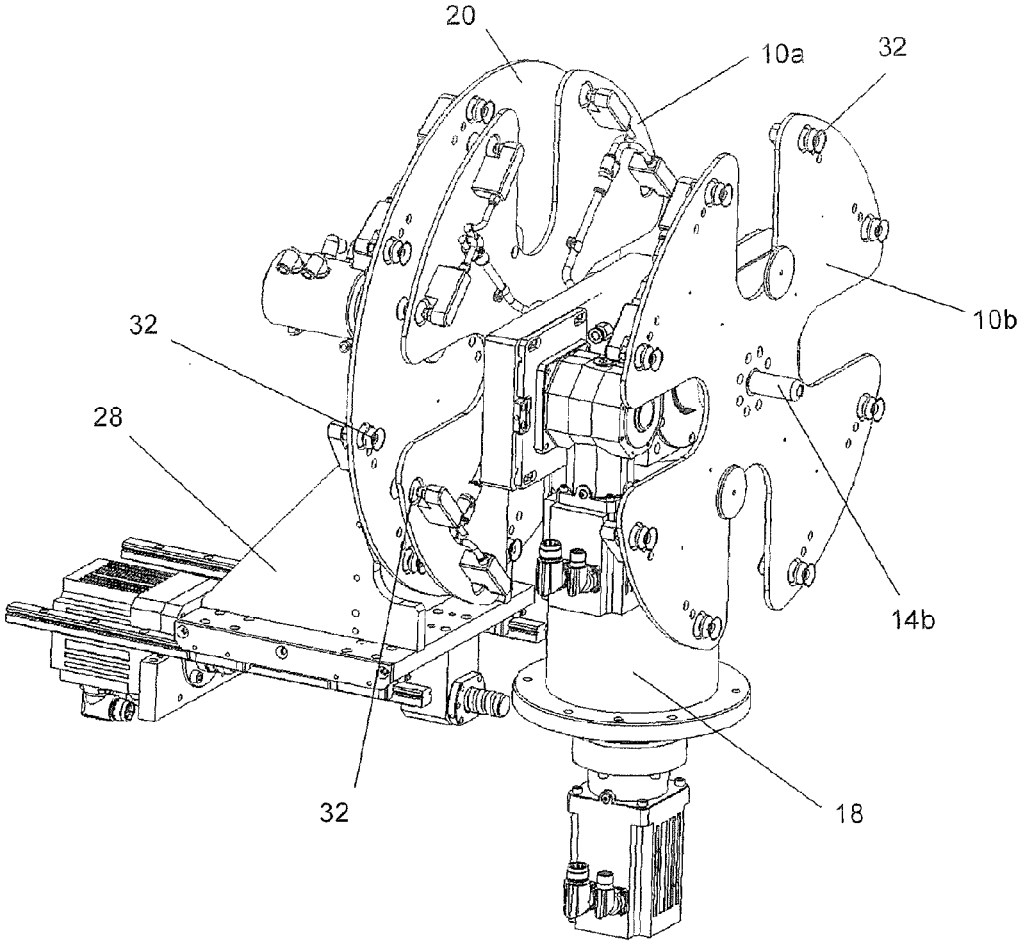
FIG. 13 a perspective view of the exemplary embodiment shown in FIG. 12.
Figure 14:
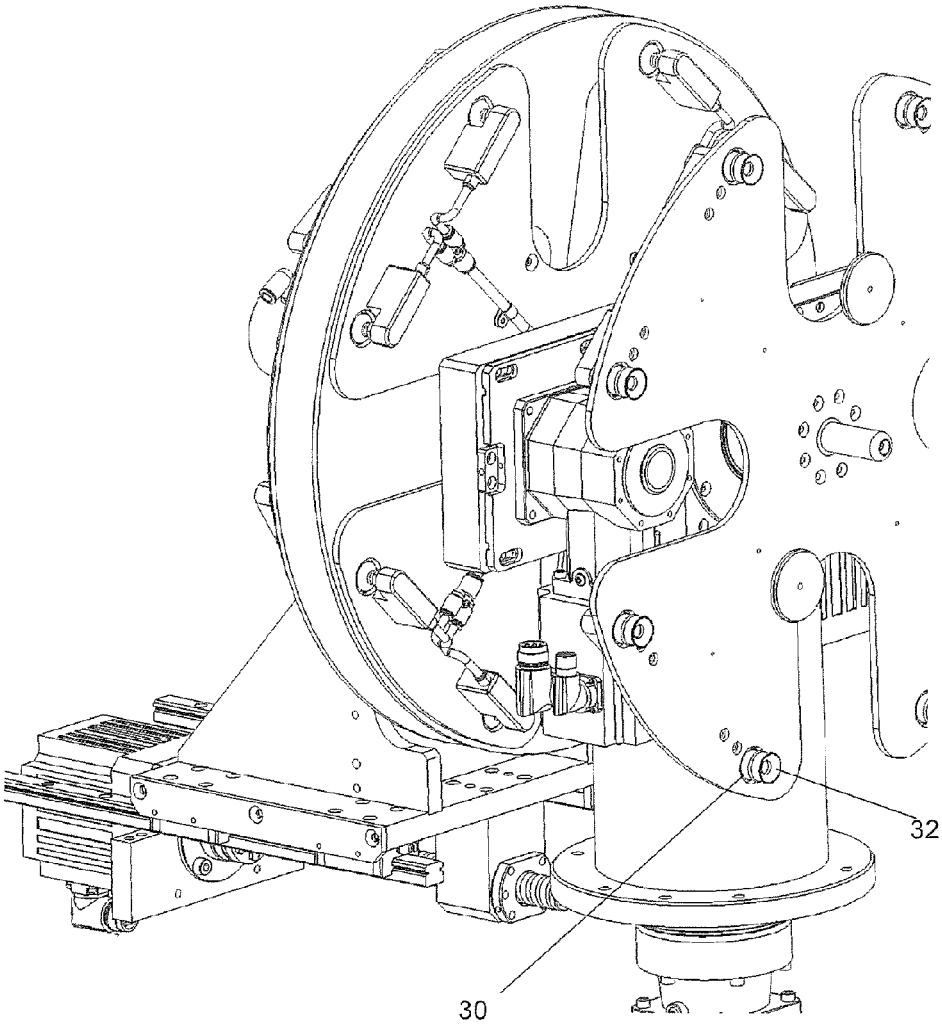
FIG. 14 a detail from the representation shown in FIG. 13.
Figure 15:
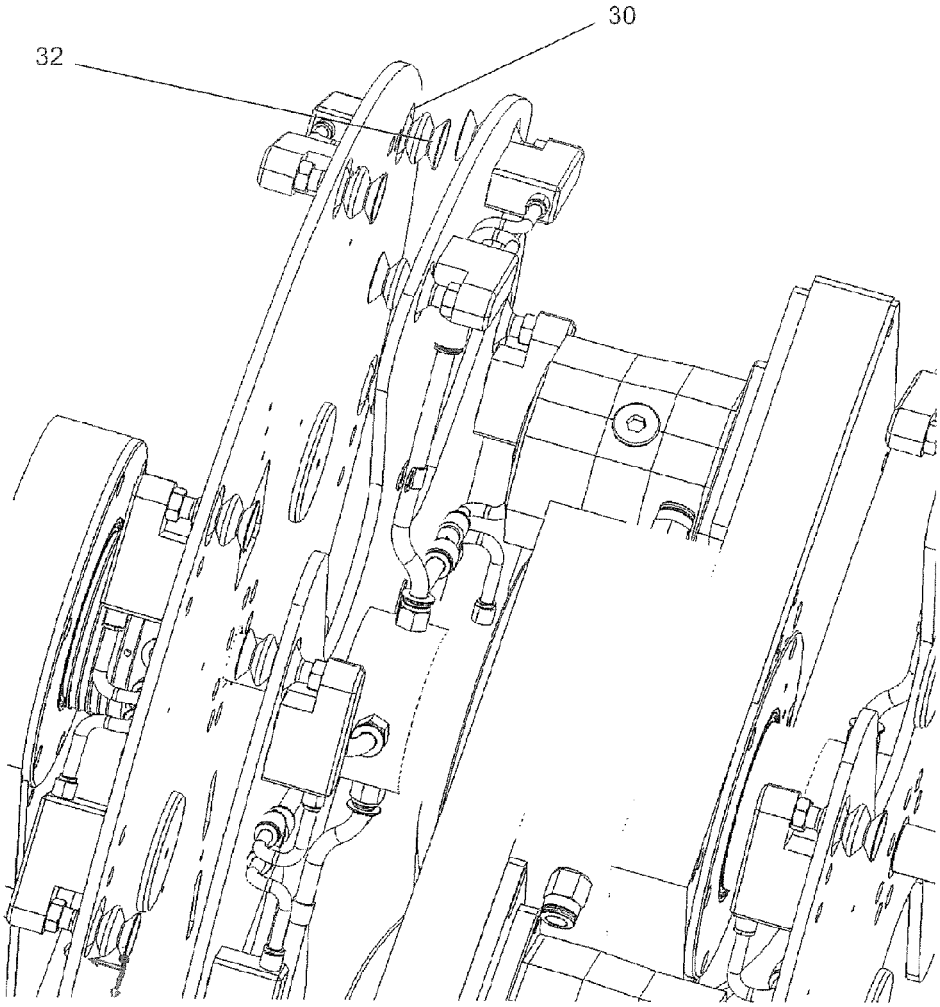
FIG. 15 a detailed view of the device shown in FIGS. 13 and 14.

In this operation state, the ribbon-like material is wound onto the spool core 52 (see FIGS. 7 and 8) so that a roll 60 can form. A new spool 50' is made available during the winding operation already and is fitted onto the shaft 14*a* of the first rotating body 10*a* which points toward the outside. Once the spool is full, the drive motors 16*b* and 26 are stopped and the second rotating body 20 is moved back to its second end position and the state as shown in FIG. 9. The vertical arm 18 is then pivoted again by 180° around its vertically extending pivoting axis S, so that the empty spool 50' is in the state shown in FIG. 4 and a new cycle can start.

A second exemplary embodiment of the invention is now described with reference to FIGS. 12 to 15. The basic configuration is identical to the above-described exemplary embodiment and the same type of components are therefore also given the same reference numbers as in the first example. Owing to the additional details provided, the drive unit for the movable arm 28 can be seen in FIGS. 12 and 13, namely in the form of an endless screw 29*a* and a motor 29*b*. The operational state shown in FIG. 12 corresponds to the one shown in FIG. 5, wherein no spool is shown.

The main difference to the first exemplary embodiment is that the surfaces of the rotating bodies 10*a*, 10*b* and 20, which face the spools, are completely flat in this example, meaning they do not have thickened hub regions. As a result, the side walls of the spools 54 can be moved to a position where they are completely flat and parallel to each other. To achieve this, the rotating bodies 10*a, b* and 20 are provided with openings 30 through which the pneumatic suction elements 32 extend, as follows in particular from FIG. 15. If a spool is located between a first rotating body 10*a* or 10*b* and the second rotating body 20 and if the pneumatic suction elements 32 are activated (meaning subjected to a negative pressure), these elements suction-pull the side walls 54 of a spool until these walls respectively fit flat against the inside-facing surfaces of the rotating bodies. The pneumatic suction elements 32 are supplied with negative pressure via corresponding negative pressure lines which, in turn, can be supplied with negative pressure via a rotary leadthrough.

Figure 16:
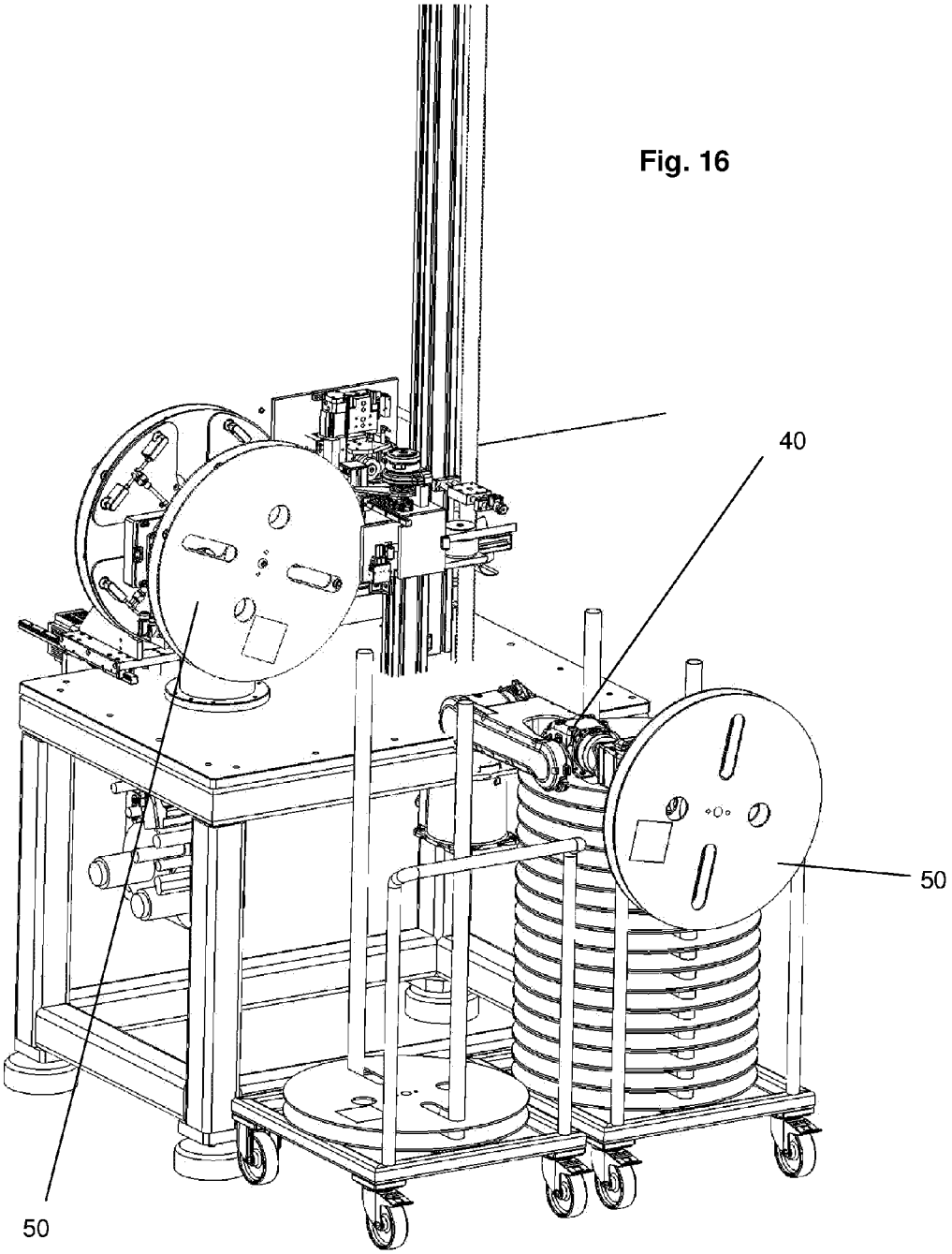
FIG. 16 the device according to FIGS. 12 to 15 which is mounted on a table that also supports a robot used for the spool exchange.

FIG. 16 again shows the device from the second exemplary embodiment, wherein this device is mounted on a table which additionally supports a robot for the spool exchange.

The spool axes for the exemplary embodiments shown herein respectively extend horizontal. However, that is not an absolute requirement. Other embodiments are possible as well, in particular embodiments having a vertically extending spool axis.

REFERENCE NUMBER LIST

10*a, b* first rotating body
12*a, b* hub region
14*a, b* shaft
16*a, b* drive motor
18 vertical arm
19 motor
20 second rotating body
22 hub region
23 recess
26 drive motor
28 movable arm
29*a* screw
29*b* motor
30 opening
32 pneumatic suction element
34 connection side
36 suction side
38 center section
40 robot
50, 50' spool
52 spool core
54 side wall
60 roll

What is claimed is:

1. A device for winding ribbon-like material onto a spool, said device comprising:

at least a first rotating body that is mounted to rotate around a spool axis;

at least a second rotating body mounted to rotate around the spool axis and mounted to move in an axial direction thereof from a first end position, relative to the spool axis, to a second end position, relative to the spool axis, wherein when the second rotating body is in the first end position, the second rotating body is closer to the first rotating body than when the second rotating body is in the second end position;

at least one rotary drive by means of which the first and second rotating bodies rotate jointly around the spool axis when the second rotating body is located in the first end position; and holding elements including first holding elements and second holding elements, the first rotating body is provided with the first holding elements positioned in an edge region of the first rotating body, the second rotating body is provided with the second holding elements positioned in an edge region of the second rotating body, the first and second holding elements for pulling side walls of the spool towards the first and second rotating bodies in the axial direction, the first holding elements each being a pneumatic suction element having a first suction side provided with at least one opening, each of the first suction sides for holding the spool and having a relative position relative to the first rotating body being changed while the first suction side is in contact with the spool, the second holding elements are each a pneumatic suction element having a second suction side provided with at least one opening, each of the second suction sides for holding the spool and having a relative position relative to the second rotating body being changed while the second suction side is in contact with the spool.

2. The device according to claim 1, wherein the relative positions of the first and second suction sides of the first and second holding elements are changed in the axial direction with respect to the spool axis.

3. The device according to claim 1, wherein the pneumatic suction elements respectively comprise a center section having bellows.

4. The device according to claim 1, wherein the pneumatic suction elements of the first holding elements extend through openings in the first rotating body to extend to an outside of the first rotating body, and the pneumatic suction elements of the second holding elements extend through openings in the second rotating body to extend to an outside of the second rotating body.

5. The device according to claim 1, further comprising a shaft extending outward from one of the first and the second rotating bodies.

6. The device according to claim 5, wherein another of the first and second rotating bodies, which does not have the shaft, is provided with a recess for accommodating the shaft.

7. The device according to claim 1, wherein the at least the first rotating body includes at least two first rotating bodies, or the at least the second rotating body includes at least two second rotating bodies.

8. The device according to claim 7, wherein the two first rotating bodies are provided, and the two first rotating bodies are mounted to exchange their positions through a pivoting movement.

9. The device according to claim 8, wherein an axis for the pivoting movement is perpendicular to the spool axis.

10. The device according to claim 1, wherein the side walls of the spool are pulled towards the first and second rotating bodies in the axial direction by the first and second holding elements such that a distance, measured in the axial direction, between one of the walls of the spool and the first rotating body is greater at an inner periphery of the spool than at an outer periphery of the spool, and a distance, measured in the axial direction, between another of the walls of the spool and the second rotating body is greater at the inner periphery of the spool than at the outer periphery of the spool.

11. The device according to claim 1, wherein the pneumatic suction elements of the first holding elements extend through openings in the first rotating body to have portions disposed outside the first rotating body, and the pneumatic suction elements of the second holding elements extend through openings in the second rotating body to have portions disposed outside the second rotating body.

* * * * *